US005133689A

United States Patent [19]

Aalto et al.

[11] Patent Number: 5,133,689

[45] Date of Patent: Jul. 28, 1992

[54] FOCUSSED VENTILATION PROCEDURE OF A WORK SPOT AND A FOCUSSED VENTILATION MEANS

[75] Inventors: Erkki Aalto, Kausala; Teuvo Pellinen, Villähde; Jouko Eloranta, Kausala, all of Finland

[73] Assignee: Halton Oy, Finland

[21] Appl. No.: 460,897

[22] PCT Filed: Jun. 8, 1989

[86] PCT No.: PCT/FI89/00101

§ 371 Date: Feb. 9, 1990

§ 102(e) Date: Feb. 9, 1990

[87] PCT Pub. No.: WO89/11927

PCT Pub. Date: Dec. 14, 1989

[30] Foreign Application Priority Data

Jun. 10, 1988 [FI] Finland ..... 882761

[51] Int. Cl.[5] ..... F23J 11/00

[52] U.S. Cl. ..... 454/49; 454/65; 454/67

[58] Field of Search ..... 98/115.1, 115.4

[56] References Cited

U.S. PATENT DOCUMENTS

| | | | |
|---|---|---|---|
| 2,567,776 | 9/1951 | Lundy | 98/115.1 |
| 2,579,401 | 12/1951 | Schneible et al. | 98/115.1 |
| 3,880,061 | 4/1975 | Hensiek et al. | 98/115.1 |
| 4,134,331 | 1/1979 | Bender | 98/115.1 |

FOREIGN PATENT DOCUMENTS

| | | | |
|---|---|---|---|
| 219335 | 2/1910 | Fed. Rep. of Germany | 98/115.1 |
| 2657067 | 8/1979 | Fed. Rep. of Germany . | |
| 3404775 | 7/1985 | Fed. Rep. of Germany . | |
| 2365381 | 4/1978 | France | 98/115.1 |
| 2061156 | 5/1981 | United Kingdom . | |

*Primary Examiner*—Harold Joyce
*Attorney, Agent, or Firm*—Steinberg & Raskin

[57] ABSTRACT

A focussed ventilation method and apparatus for a work spot wherein at least a first focussed suction (11) and at least one additional focussed suction (13) are arranged to draw the air and/or gas and/or excess heat of the work spot, and arranged to interact so that the first focussed suction (11) draws the more detrimental air in quality than that drawn by the additional focussed suction (13).

12 Claims, 4 Drawing Sheets

FOCUSSED VENTILATION PROCEDURE OF A WORK SPOT AND A FOCUSSED VENTILATION MEANS

The present invention concerns a focussed ventilation method and a focussed ventilation of a work space.

Focussed ventilation apparatus for air impurities are known in the art, wherein suction is focussed on a source of impurity of each work space. Impurities are drawn off from the job target prior to coming into contact with the person working at the work space. However, in the focussed ventilation procedures of the prior art it has not been feasible to remove impurities to a sufficient extent. Therefore, a relatively high concentration of impurities has entered the respiratory zone of the person working in the work place.

SUMMARY OF THE INVENTION

The object of the invention is a completely novel focussed ventilation method and a focussed ventilation apparatus. Specifically, the aim is a method and an apparatus in which majority of the impurities can be removed from the work spot prior to their transmission into the zone of the person working in the work space.

The method of the invention comprises bringing the majority of the air space of the person working in the work space is with the aid of the suction of a suction apparatus into movement. The air of the work space is drawn with the aid of a first focussed suction and additional focussed suction. With the aid of the first focussed suction most of the impurity concentration and/or excess heat is/are removed, and with the aid of the additional focussed suction the residual impurities and/or excess heat is/are removed.

The method of the invention is mainly characterized in that at least a first focussed suction and at least one additional focussed suction are used, these being arranged to draw the air and/or gas and/or excess heat of the work spot and to interact so that the first focussed suction draws off the air which is more detrimental in quality than the air drawn off by the additional focussed suction.

The focussed ventilation apparatus of the invention is mainly characterized in that the apparatus comprises at least one suction duct for the actual focussed suction, through which duct a majority of the impurities and/or excess heat produced in the work space is/are removed, and that the apparatus comprises at least one suction duct for additional suction, through which duct residual impurities are removed from the work space.

BRIEF DESCRIPTION OF THE DRAWINGS

The invention is described in the following referring to a number of advantageous embodiments of the invention presented in the Figures of the drawing but to which the invention is not intended to be exclusively confined.

FIGS. 4A–4D are sections taken along lines I—I of FIG. 3. In FIG. 4D is presented the distribution of impurity concentration in flow cross-section surfaces.

Figure 2A:
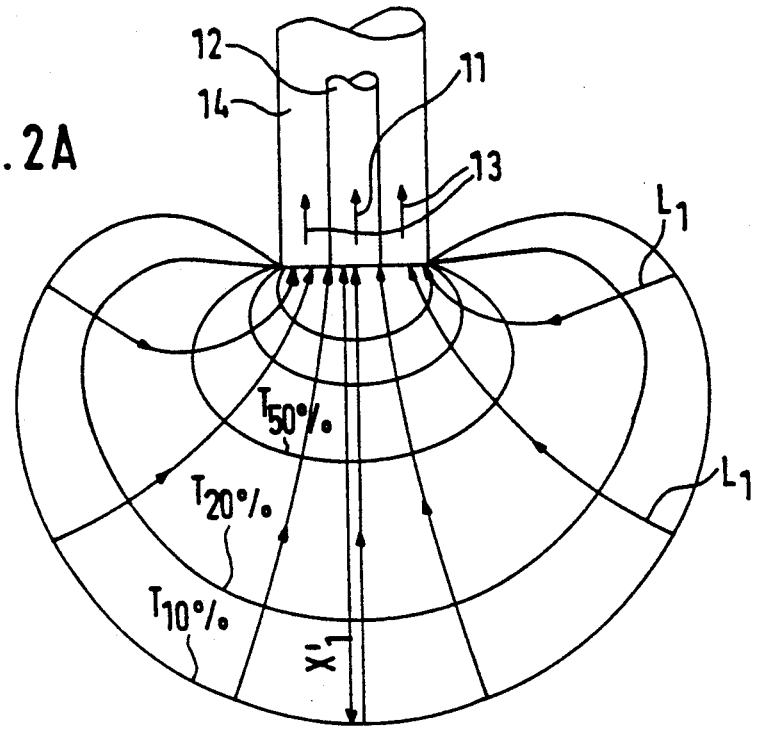
FIG. 2A presents schematically an embodiment of the invention as a cross-sectional image in which the apparatus comprises a central suction duct and a second suction duct therearound.
Figure 2B:
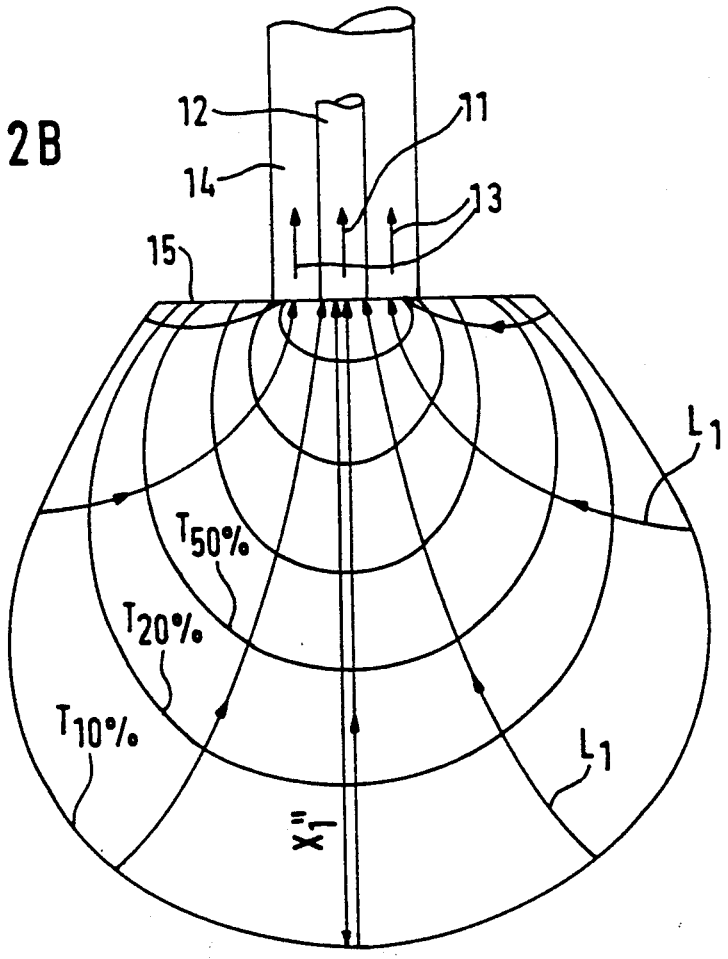
FIG. 2B presents schematically a portion of the embodiment of FIG. 1 provided with an edge flange.

FIGS. *6A–6C* present duct cross-sections related to the embodiment shown in FIGS. 2A and 2B.

Figure 7:
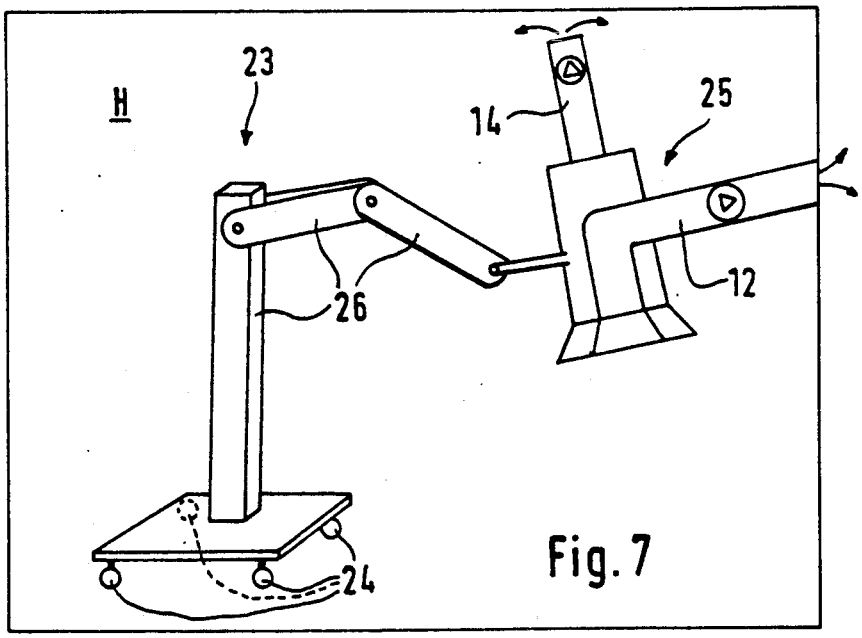

FIG. 7 presents a movable focussed ventilation means.

DESCRIPTION OF THE PREFERRED EMBODIMENTS

Figure 1:
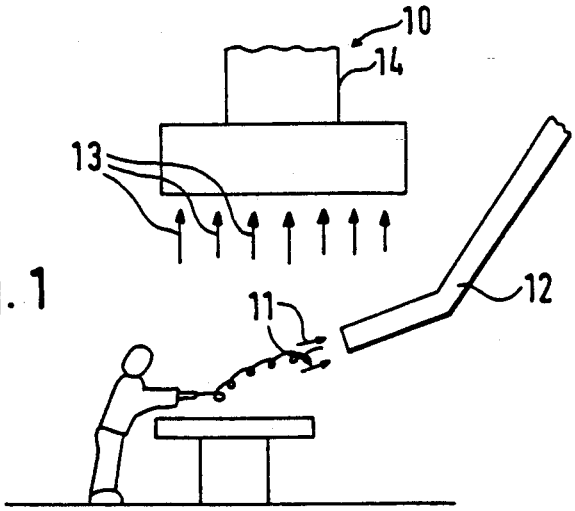
FIG. 1 presents a schematic view the most common embodiment of the procedure of the invention and the means of the invention.

FIG. 1 presents schematically a first embodiment of the procedure of the invention. The figure shows a person working at a work spot, e.g. a welder. As taught by the invention, two separate suctions are directed at the work spot. The focussed ventilation apparatus 10 comprises means 12 generating the first focussed suction 11 with which first focussed suction is focussed directly on the source of impurities from the suction duct 11. In addition, the apparatus 10 comprises means 14 for generating additional focussed suction 13 with which said additional focussed suction 13 is also focussed on the region of impurities. In the figure are indicated the properties typical of the apparatus. The focussing of the first focussed suction 11 is carried out directly on a source of impurities, e.g. on flue gases caused by welding. Through the suction duct 12 of the first focussed suction 11 majority a and advantageously, about 70 to 95 per cent of the impurities of the work space are drawn off.

With the aid of the additional focussed suction 13 the residual impurities are drawn off through a focussed suction duct 14 from the respiratory zone of the person working in said work spot. The majority of the air can be circulated back into the room space. The cross-sectional area of the flow in the first suction duct 12 is smaller than the cross-sectional area of the flow in the second suction duct 14.

As mentioned above, in the apparatus designs of the state of art, one focussed suction duct only was used, whereby a given portion, that is, about 20 to 50 per cent of the impurities detrimentally enter the respiratory zone. As taught by the invention, this great drawback is avoided. The object of the additional focussed suction 13 is to bring great air masses into movement directly in the work space of the person. The first focussed suction is required to be focussed sharply directly on the impure gases generated e.g. by welding.

In FIG. 2A is presented a second advantageous embodiment of the method an apparatus of the invention. In the method, the focussed suction 11 proper is focussed centrally on the source of impurities, and the additional focussed suction 13 is brought into the vicinity of the source of impurities around the first focussed suction. As taught by the invention, the additional focussed suction 13 enhances the effect of the first focussed suction 11, and therefore, the effect of the first focussed suction extends further than in the instances in which no additional focussed suction 13 exists. The aim of the additional focussed suction 13 is particularly to lengthen the effective length X of the first focussed suction 11. Another aim of the additional focussed suction 13 is to act as a guide suction for the first focussed suction 11 and, consequently, it aids in removing impurity gases of the source of impurities from the work spot.

In the figure are depicted the flow curves. The passage of the air flow is presented with arrows $L_1$. The so-called balance curves of the flow are indicated in letters in the figure $T_{100\%}-T_{n\%}$.

The balance curve $T_{100\%}$ is located on the end of the duct system and the balance curve $T_{10\%}$ is located furthermost away. The balance curve $T_{10\%}$ refers to an instance in which the flow rate is 10% of the flow rate into the duct 12 in the suction aperture. Respectively, the case $T_{50\%}$ refers to a balance curve in which the flow rate on the flow rate of the suction aperture is 50%. However, what is essential in the presentation of the figure is that the length of the first focussed suction can be adjusted with the aid of the additional focussed suction.

Another advantage is that the air of the additional focussed suction can be moved back into the room space because the content of impurities therein are nearly non-existent. Consequently, an obvious saving of energy is obtained.

In FIG. 2B is presented a design otherwise equivalent to the one shown in FIG. 2A, with the exception that the additional focussed suction duct 14 has been provided with a flange 15. With the aid of the flange 15, the shape of the curves $T_1-T_n$ can be changed. In particular, the position and shape of the curve $T_{10\%}$ changes. In the instance of FIG. 2B, the suction with the aid of the flange 15 both through the first suction duct 12 and the additional suction duct 14 can be enhanced, that is, the suction effect can be extended over a longer distance. The distance of the peak point of the curve $T_{10\%}$ from the duct mouth is greater in the instance of FIG. 2B than in the instance of FIG. 2A, that is, it is $x_1''>x_1'$.

By using additional focussed suction, a flow field is produced in a work space which directs impurities and/or excess heat to pass mainly into the actual focussed suction.

Figure 3:
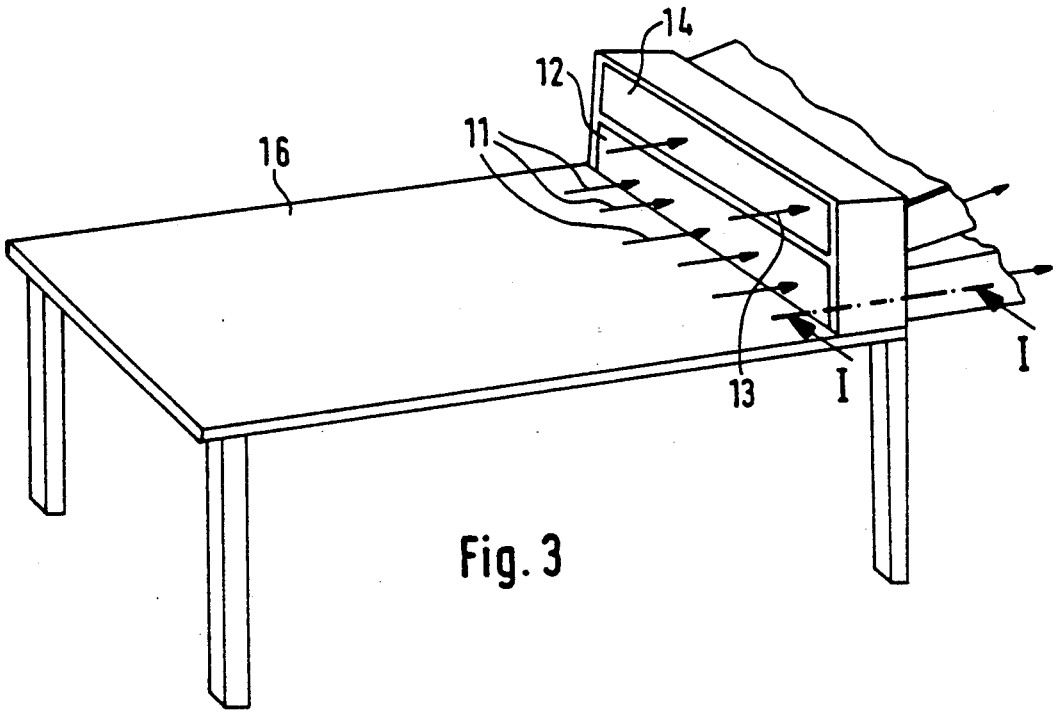
FIG. 3 presents a third advantageous embodiment of the method and the apparatus of the invention in axonometric image.

In FIG. 3 is presented a third advantageous embodiment of the method of the invention and the apparatus in axonometric image. The apparatus arrangement and the method presented in the Figure may be used in particular in instances in which the impurities are removed in a direction substantially parallel to the working surface into the first focussed suction duct 12. The apparatus comprises means generating the actual focussed suction 11 with which the actual focussed suction 11 is focussed on the source of impurities through the focussed suction duct 12. The suction is focussed to the ventilation means along a working surface 16. The additional focussed suction duct 14 focusses the additional focussed suction 13 above the work space in that the additional focussed suction protects the actual focussed suction and moreover, residual impurities and/or excess heat are removed therewith from the stay zone of the person working in the work space. Through the actual focussed suction duct 12 a majority of the impurities are removed, and through the additional focussed suction duct 14 the residual impurities and/or excess heat are removed.

The additional focussed suction 13 may be located above, and/or below and/or on the sides of, and or/around the surface 16. The working surface 16 may be e.g. a perforated plate, whereby the additional focussed suction may be located below the working surface 16.

Figure 4A:
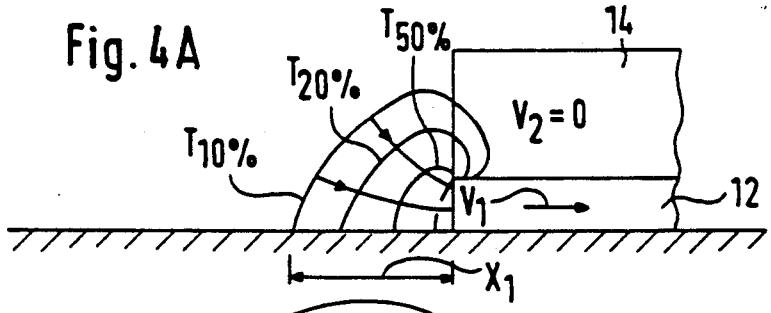
FIGS. 4A–4D present the flow curves of the apparatus embodiment of FIG. 3.
Figure 4B:
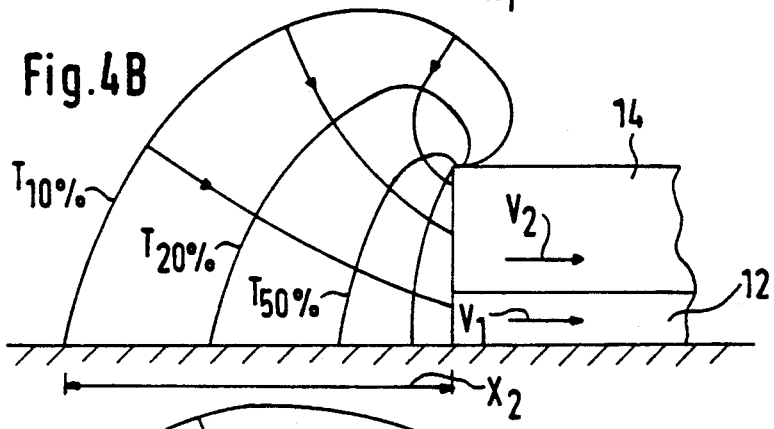
Figure 4C:
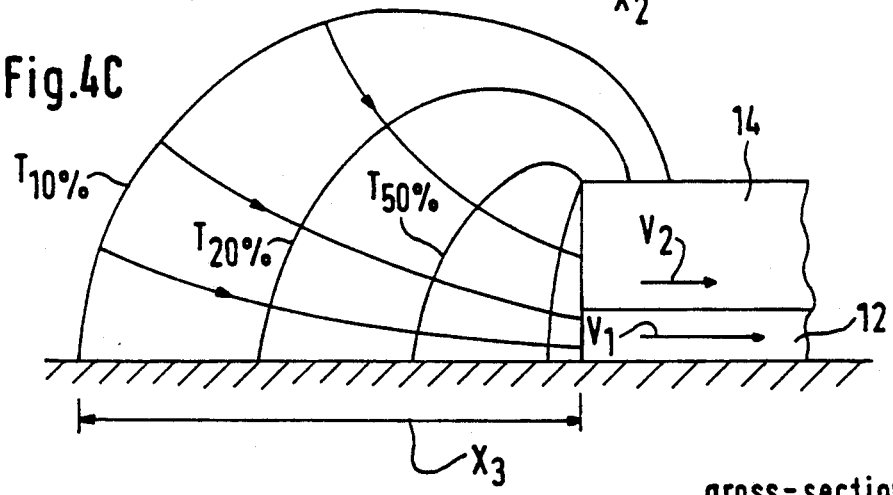

In FIG. 4A–4C is presented a section along lines I—I of FIG. 3.

In FIG. 4A–4C, three different instances are presented. The flow passing through the first focussed suction duct 12 closest to the table is maintained in the value $v_1$ at the duct mouth. The flow rate $v_2$ of the additional focussed suction 13 is changed at the duct mouth of a second focussed suction duct.

In the instance of FIG. 4A, $v_2=0$ and $v_1\neq 0$. In the instance of FIG. 4B $v_2=v_1\neq 0$. When the curves of $T_{10\%}$ in FIGS. 4A and 4B are compared with one another, it is seen that carrying the additional focussed suction 13 through the duct 14 lengthens and enhances considerably the effect of the first focussed suction 11. Consequently, the distance $X_2>>X_1$.

In the instance of FIG. 4C, the flow rate $v_2>v_1$ of the air flow through the second suction duct 14 is enlarged. With this arrangement, the suction distance $X_3$ (curve $T_{10\%}$) is further affected, which in comparison with instances 4B and 4A is considerably longer. Consequently, $X_3>X_2>X_1$. It may be noted that the balance curves $T_{10\%}$, $T_{20\%}$, $T_{50\%}$ move when proceeding from instance 4A to instance 4C to the left (see the figure).

By controlling the suction through the ducts 12 and 14 it is feasible to affect the suction properties of the apparatus, and in particular, the elimination of impurity carried out through the suction duct 12 on the first focussed suction.

Figure 4D:
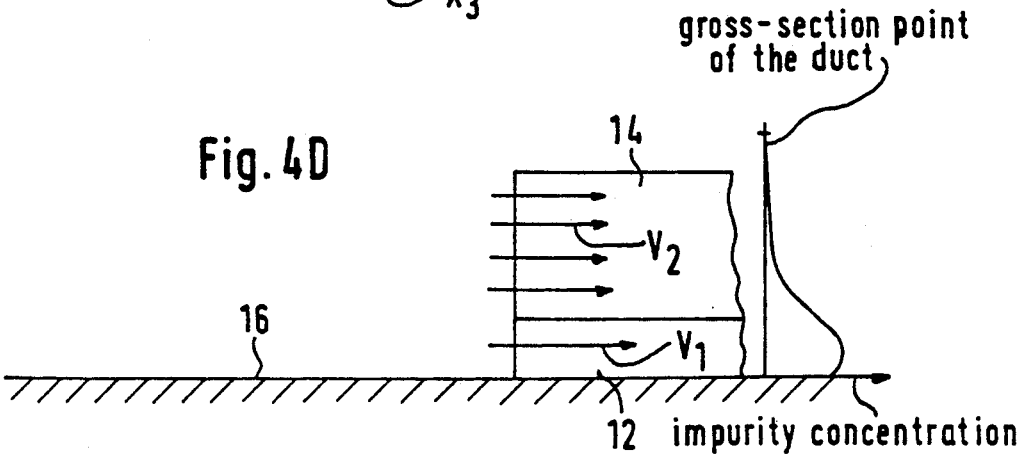

In FIG. 4D is presented the concentration profile of the impurity content on the cross-sectional plane I—I of the suction ducts 12 and 14 of the means presented in FIG. 3. The Figure shows that the impurity content increases sharply at the actual focussed suction 11. The size of the impurity concentration is also affected by the flow guiding effect of the working surface 16. The impurity particles tend to travel parallel to the surface, directly into the focussed suction duct 12 of the actual focussed suction.

Figure 5:
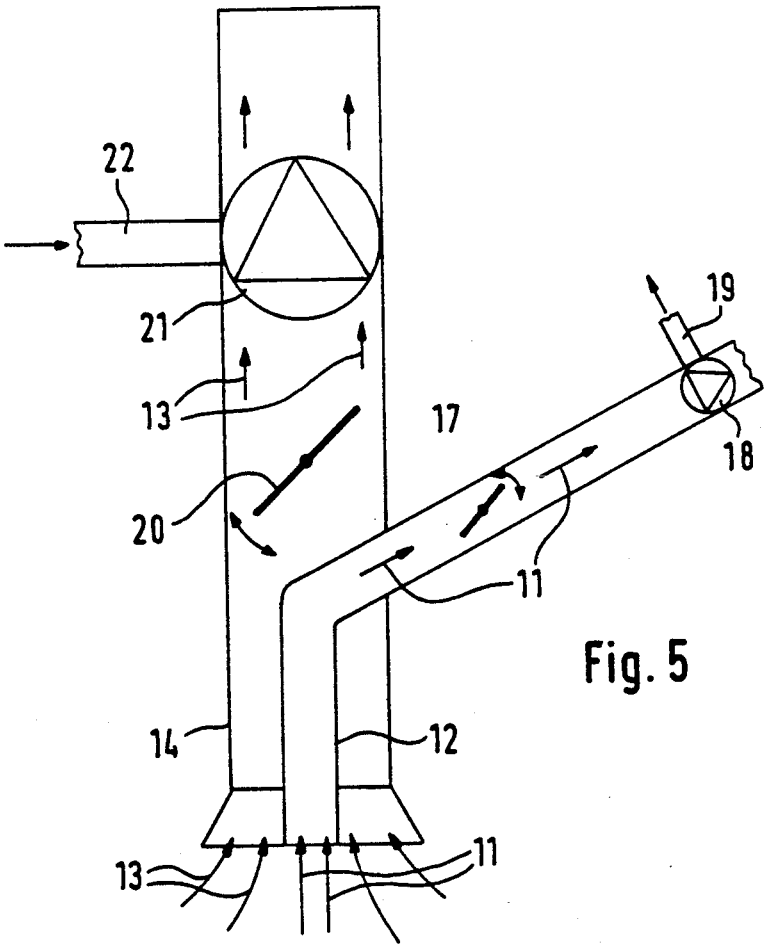
FIG. 5 presents schematically apparatus used for adjusting focussed suctions of the focussed ventilation means.

In FIG. 5 is presented the adjustment of the focussed suctions 11 and 13 used in the method of the invention. The figures shows primarily the apparatus design of FIG. 2A and 2B. These adjustments are also appropriate for other embodiments of the invention. The actual impurity removal taking place through the focussed suction duct 12 is regulated with a regulating damper 17 placed in the duct 12. By opening and closing this regulating damper 17 the flow is strengthened and the strength of the suction is affected. In the partly schematical presentation of FIG. 5, a thyristor adjustment 19 of a blower 18 is presented. By changing the speed of rotation or volume of rotation of the blower 18 the differential pressure is changed over the blower, and consequently the suction effect from the first suction duct 12. Respectively, in the embodiment of FIG. 5 is presented the adjustment of the additional focussed suction 13 with a regulating damper 20 placed in the focussed suction duct 14. By closing and opening this damper the flow passing through the duct 14 is choked. In the figure is also shown the thyristor adjustment of the blower 21. The adjustment apparatus 22 adjusts the speed of rotation of the fan 21 and in that manner, the differential pressure over the blower. It is also feasible to regulate the rotational volume of the blower. The adjustment may also be implemented using so-called by-pass flow. An air flow is flown partly past a duct and through a by-pass duct. The adjustment may also be performed as a combination of the above-mentioned adjustment procedures.

Figure 6A:
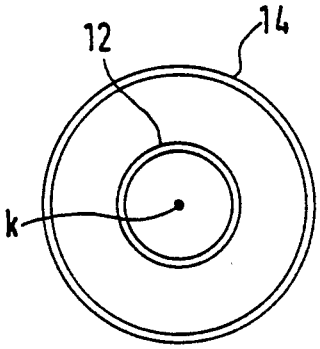
Figure 6B:
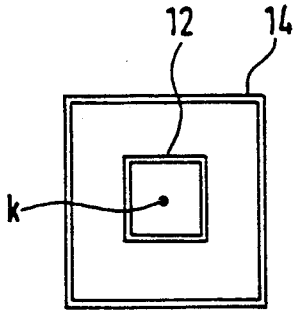
Figure 6C:
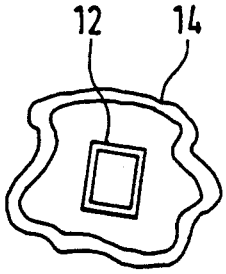

In FIGS. 6A–6C are presented some advantageous duct cross-section configurations of the suction ducts of the focussed outlet means presented in FIG. 2A and 2B. The central axis of the duct systems 12 and 14 is indicated by k in FIG. 6A and 6B. In the instance of FIG. 6A, both the suction duct 12 of the first focussed suction and the suction duct 14 of the additional focussed suction are circular in cross-section. In the instance of FIG. 6B, the duct system is of rectangular and advantageously of square cross-sectional shape. In the instance of FIG. 6C, the suction ducts 12 and 14 of the actual focussed suction and the additional focussed suction are made of a tubular structure of indefinite shape, whereby the suction duct 12 of the actual focussed suction is located within the suction duct 14 of the additional focussed suction. The suction duct of the first focussed suction and the suction duct of the additional focussed suction need not be located symmetrically relative to one another. In cross-sectional shape the ducts may also be asymmetric.

In FIG. 7 is presented an advantageous embodiment of the focussed outlet means. In the embodiment of FIG. 7 the apparatus comprises a base 23 which is a carriage movable on wheels 24. The base 24 comprises a focus exchange member 25 which can be positioned at a certain height, its position being with the aid of movable arms 26 adjustable as desired. The apparatus comprises furthermore a suction duct 12 for the first focussed suction and a suction duct 14 for the additional focussed suction. In the embodiment of FIG. 7, the impurities removed with the first focussed suction are moved off from the room space H, and the air of the work space removed with the additional focussed suction is discharged into the same room space H but outside the work space.

We claim:

1. A method for ventilating a work space of a certain volume which is situated within a room having a larger volume, said method comprising the steps of;

using a first suction means including a first duct having a first inlet to suction air from said work space to a first outlet;

using an additional suction means including a second duct having a second inlet focussed on said work space, said second inlet surrounding said first inlet to produce a flow field in said work space to guide impurities and excess heat therein toward said first suction means such that the effect of said first suction means is lengthened in said work space and enhanced by said additional suction means, whereby changing the amount of air suctioned by said addition suction means relative to said first suction means changes the amount of air suctioned by said first suction means, and using said additional suction means to suction additional air containing residual impurities from said work space to a second outlet.

2. The method of claim 1, further comprising causing a greater air flow rate in said additional suction means than in said first suction means.

3. The method of claim 1, further comprising using said first suction means to suction air from said work space to a location outside of said room and using said additional suction means to suction said additional air from said work space to a location within said room outside of said work space.

4. The method of claim 1, further comprising focussing said first suction means on said first area within said work space and focussing said additional suction means on a second area within said work space, said second area being greater than and surrounding said first area.

5. The method of claim 1, further comprising focussing said first suction means so as to remove impurities and heat from a portion of said work space immediately adjacent to a working surface and focussing said additional suction means so as to remove impurities from within said work space outside of said portion of said work space.

6. The method of claim 1, further comprising using a regulating damper to regulate the air flow of said first suction means.

7. The method of claim 1, further comprising using a regulating damper to regulate the air flow of said additional suction means.

8. An apparatus for ventilating a work space of a certain volume which is situated within a room having a larger volume, said apparatus comprising:

a first suction means including a first duct having a first inlet oriented so as to suction air from said work space to a first outlet;

an additional suction means including a second duct having a second inlet oriented so as to produce a flow field in said work space to guide impurities and excess heat therein toward said first suction means such that the effect of said first suction means is lengthened in said work space and enhanced by said additional suction means, said second inlet surrounding said first inlet, and said additional suction means operating to remove additional air containing residual impurities from said work space to a location within said room outside of said work space to a second outlet.

9. The apparatus of claim 8, wherein said first suction means comprise a first suction duct and said additional suction means comprises an additional suction duct and wherein said additional suction duct has a greater flow cross-sectional area than said first suction duct.

10. The apparatus of claim 8, wherein said first suction means is situated so as to suction air from said work space to a location outside of said room and said second suction means is situated so as to suction air from said work space to a location within said room outside of said work space.

11. The apparatus of claim 8, further comprising said additional suction means being situated so as to surround said first suction means while being focussed substantially parallel to said first suction means.

12. The apparatus of claim 8, wherein said first suction means is focussed on a first portion of said work space immediately adjacent to a working surface and said additional suction means is focussed on an area of said work space outside of said first portion of said work space.

* * * * *